United States Patent [19]

Schuh

[11] Patent Number: 4,519,463

[45] Date of Patent: May 28, 1985

[54] DRAINHOLE DRILLING

[75] Inventor: Frank J. Schuh, Dallas, Tex.

[73] Assignee: Atlantic Richfield Company, Los Angeles, Calif.

[21] Appl. No.: 590,940

[22] Filed: Mar. 19, 1984

[51] Int. Cl.[3] ..... E21B 7/06

[52] U.S. Cl. ..... 175/61; 166/50

[58] Field of Search ..... 175/61; 166/50, 369

[56] References Cited

U.S. PATENT DOCUMENTS

| | | | |
|---|---|---|---|
| 2,404,341 | 7/1946 | Zublin | 175/61 |
| 4,194,580 | 3/1980 | Messenger | 175/61 |
| 4,386,665 | 6/1983 | Dellinger | 175/61 |

FOREIGN PATENT DOCUMENTS

| | | | |
|---|---|---|---|
| 431292 | 5/1975 | U.S.S.R. | 175/61 |

OTHER PUBLICATIONS

"ARCO Drills Horizontal Drainhole for Better Reservoir Placement" by Moore III—Sep. 15, 1980.

*Primary Examiner*—James A. Leppink
*Assistant Examiner*—Hoang C. Dang
*Attorney, Agent, or Firm*—Roderick W. MacDonald

[57] ABSTRACT

A method for drilling a well in the earth for the production of minerals therefrom wherein a primary wellbore is first drilled into the earth, the primary wellbore being a deviated wellbore having a radius of curvature in the range of from about 2.5 to about 6 degrees per 100 feet of primary wellbore length, and then drilling from said primary wellbore at least one drainhole wellbore, said drainhole wellbore having a radius of curvature in the range of from about 0.2 to about 3 degrees per 1 foot of drainhole wellbore length.

7 Claims, 4 Drawing Figures

DRAINHOLE DRILLING

BACKGROUND OF THE INVENTION

Drainhole wellbores are well known in the art, for example, see U.S. Pat. No. 4,397,360. Generally, drainhole wellbores are drilled laterally from an essentially vertical primary wellbore in the earth. The goal is to extend the drainhole wellbore essentially horizontally away from the vertical primary wellbore to achieve as good a drainage as possible from as far out into the oil and gas producing reservoir as possible.

SUMMARY OF THE INVENTION

In accordance with this invention, there is provided a method for drilling at least one well in the earth for the production of hydrocarbons and/or other minerals therefrom wherein a primary wellbore is drilled which is not an essentially vertical wellbore, but rather is a directional or deviated wellbore which curves in a gradual manner a substantial distance from the point of the earth's surface where the primary wellbore is initially started. The radius of curvature for the gently curving primary wellbore is in the range of from about 2.5 to about 6 degrees per 100 feet of primary wellbore length. After the primary wellbore has been drilled to the desired extent, at least one drainhole wellbore is drilled from the primary wellbore to extend into or near a subterranean area from which hydrocarbons and/or other minerals are to be produced. The drainhole wellbore is a sharply curving wellbore, as compared to the primary wellbore and will have a radius of curvature in the range of from about 0.2 to about 3 degrees per 1 foot of length of drainhole wellbore.

Thus, in accordance with this invention, instead of drilling drainhole wellbores essentially horizontally away from an essentially vertical primary wellbore, drainhole wellbores are, in accordance with this invention, drilled upwardly or downwardly or at other angles with respect to an essentially horizontally extending primary wellbore.

Accordingly, it is an object of this invention to provide a new and improved method for the production of minerals from the interior of the earth.

It is another object to provide a new and improved method for the use of drainhole wellbores.

Other aspects, objects and advantages of this invention will be apparent to those skilled in the art from this disclosure and the appended claims.

DETAILED DESCRIPTION OF THE INVENTION

Figure 1:
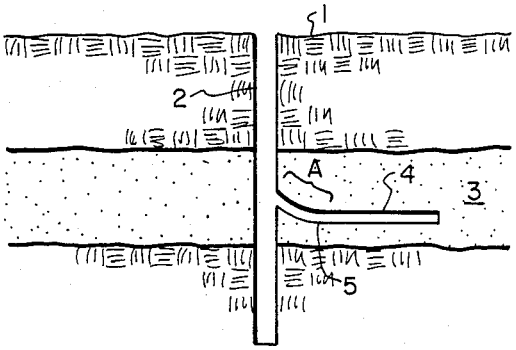
FIG. 1(PRIOR ART)
FIG. 1 shows a prior art use of a drainhole wellbore.

FIG. 1 shows the earth's surface 1 with an essentially vertical primary wellbore 2 extending downwardly into the earth and penetrating a mineral producing subterranean reservoir 3. A drainhole wellbore 4 has been drilled from primary wellbore 2 in an essentially horizontal manner. Drainhole 4 extends laterally away from primary wellbore 2 using a sharp radius of curvature zone A so that a relatively sharp turn in zone A changes, in a short distance, drainhole wellbore 4 from essentially vertical at the point where it leaves wellbore 2 to essentially horizontal at end 5 of zone A. Thus, in very short transition zone A, an essentially 90 degree angle is turned from vertical to horizontal. Drainhole wellbore 4 is then drilled as far as possible away from primary wellbore 2 out into zone 3 for maximum drainage of minerals such as oil and gas from zone 3 into wellbore 4 and from there into wellbore 2 for production to and recovery at earth's surface 1.

Figure 2:
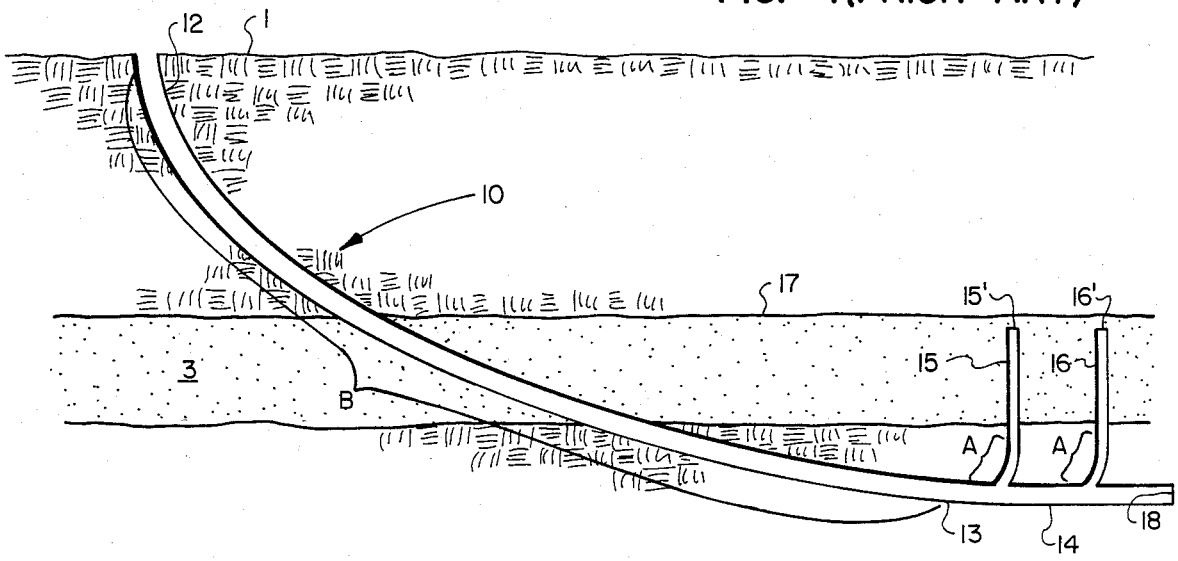
FIG. 2 shows one embodiment within this invention wherein upwardly extending drainhole wellbores are drilled from an essentially horizontal section of a deviated primary wellbore.

In FIG. 2, there is shown earth's surface 1 with underlying producing area or reservoir 2 in which a deviated primary wellbore 10 has been drilled. Primary wellbore 10 is comprised of a very short essentially vertical segment 11 in which the wellbore is started in the earth followed by a very long gradually curved section B in which section the radius of curvature ranges from about 2.5 to about 6 degrees per 100 feet of length of wellbore 10. Thus, between the start of curvature point 12 and the end of curvature point 13 of section B, primary wellbore 10 changes from an essentially vertical wellbore in section 11 to an essentially horizontally extending wellbore in section 14. Wellbore 10 curves very gradually in section B over a matter of hundreds and even thousands of feet in a horizontal direction in order to achieve this change of direction. This is to be contrasted with a change of direction from essentially vertical to horizontal in zone A of FIG. 1 which is accomplished with a drainhole wellbore over a horizontally extending direction of less than 100 feet and sometimes less than 50 feet.

Thus, it can be seen that a very gentle and gradual slope or curvature is employed for primary wellbore 10. Then, a sharply curving drainhole wellbore or wellbores 15 and 16 are drilled from wellbore 10 as shown in FIG. 2 to extend into or near the producing area. In the case of FIG. 2 wellbores 15 and 16 extend directly into and through most of the vertical height of producing reservoir 3. This way hydrocarbons or other minerals in reservoir 3 in the area of drainhole wellbores 15 and 16 gravitate or are otherwise produced into wellbores 15 and 16 thereby readily flowing by force of gravity or otherwise through those wellbores into wellbore 10 for production to and recovery at earth's surface 1. By this invention, a gradually curving deviated wellbore puts the primary wellbore anywhere desired relative to the producing reservoir, and a sharply curving drainhole wellbore(s) is then used to travel a short distance near or into the producing reservoir. This is in contrast to the prior art practice of extending drainhole wellbores substantial lateral distances in the reservoir as shown in FIG. 1.

Figure 3:
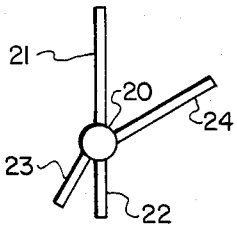
FIG. 3 shows a cross-section of a primary wellbore with a plurality of drainhole wellbores extending therefrom in accordance with this invention.

FIG. 3 shows a cross-sectional end view of a deviated primary wellbore 20 having a plurality of drainhole wellbores extending at various angles therefrom. Said wellbores can be drilled from the same relative area of wellbore 20 and/or spaced apart along the longitudinal length of that wellbore as illustrated for wellbores 15 and 16 in FIG. 2. In FIG. 3, an essentially vertical drainhole wellbore 21 and upwardly extending wellbore 24 are employed counter to a downwardly extending wellbores 22 or 23. It can be seen that a plurality of drainhole wellbores can be drilled at a plurality of points around the periphery of the primary wellbore as well as spaced apart along the length of the primary wellbore. The radius of curvature zone A of drainhole wellbores 15, 16, and 21 through 24 is in the range of from about 0.2 to about 3 degrees per one foot of length of the drainhole wellbore.

The primary wellbore as shown in FIG. 2 pierces reservoir 3 before drainhole wellbores 15 and 16 are drilled upwardly into that reservoir. As desired, the area of wellbore 10 in zone B and in reservoir 3 can be completed to make that a producing well or can be completed to prevent production of recoverable minerals into that portion of the wellbore thereby leaving essentially all production of minerals from reservoir 3 to be achieved by way of wellbores 15 and 16. It is not necessary that wellbore 10 pass through reservoir 3. Instead, wellbore 10 could be curved so as to reach an essentially horizontal orientation above the top 17 of reservoir 3. In this case downwardly extending drainhole wellbores would be drilled from the primary wellbore into reservoir 3. This would be useful in the case of a reservoir which is gas pressured and naturally flows upwardly in a wellbore and/or can readily be pumped upwardly in a conventional manner. The embodiment shown in FIG. 2 is useful not only in that type of reservoir but also in a reservoir wherein the materials do not readily flow such as in the case of a viscous crude oil, tar sand, oil shale or other similar reservoir wherein a gravity assisted flow can be desirable. Further, deviated wellbore 10 could be drilled so as to extend partially into and/or through reservoir 3 and then upwardly extending, downwardly extending, and laterally extending drainhole wellbores drilled therefrom all in reservoir 3. In any of these embodiments, the main advantage is still achieved and that is drilling the longest distances with the wellbore that has the most gradual rate of curvature, and drilling only shorter distances with the wellbore having the sharper radius of curvature. Of course, one or more drainhole wellbores could be drilled from the radius of curvature portion B of primary wellbore 10 if desired.

Figure 4:
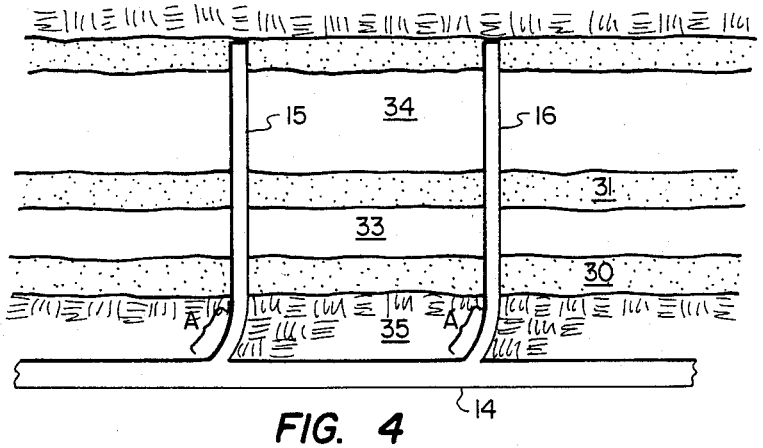
FIG. 4 shows another embodiment within this invention.

FIG. 4 shows another embodiment of this invention wherein branching drainhole wellbores 15 and 16 penetrate not just one producing formation such as shown in FIG. 2 but rather a plurality of separated, producing formations 30, 31 and 32. Thus, production of minerals is obtained from all three formations at the same time by way of each drainhole wellbore. This is a considerable advantage when, as is the case in many situations, the spaced apart producing formations 30 through 32 have interposed therebetween essentially fluid impervious formations such as shale layers 33, 34, and 35. Production from all three formations would not be achieved unless drainhole wellbores penetrated all three thereby providing a conduit for the flow of minerals through impervious layers 33 through 35. This is in clear distinction to the prior use of drainhole wellbores as represented by FIG. 1 wherein drainhole wellbore 4 would be drilled in and produce minerals from only single reservoir 3. Were the prior art techniques to be employed, three separate horizontal drainhole wellbores would be employed in each of reservoir 30, 31, and 32.

EXAMPLE

A wellbore system substantially as that shown in FIG. 2 is drilled in which primary deviated wellbore 10 has a radius of curvature in zone B of about 3 degrees per 100 feet of length of wellbore 10 in zone B. Wellbore 10 is drilled to a vertical depth below earth's surface 1 of approximately 10,000 feet and end 18 of wellbore 10 is horizontally, laterally displaced from section 11 approximately 6,000 feet. Drainhole wellbores 15 and 16 extend above wellbore 10 at their end points 15' and 16' approximately 200 feet. Thus, the thousands of feet of lateral displacement are accomplished through gradually curving section B rather than through sharply curving section A as the case would be in FIG. 1. By this invention only a coupled of hundred feet of wellbore is drilled through sharply curving zone A.

Reasonable variations and modifications are possible within the scope of this disclosure without departing from the spirit and scope of this invention.

What is claimed is:

1. In a method for drilling at least one well in the earth for the production of at least one mineral therefrom, the improvement comprising drilling a primary wellbore into the earth, said primary wellbore being a deviated wellbore having a radius of curvature in the range of from about 2.5 degrees per 100 feet of wellbore length to about 6 degrees per 100 feet of wellbore length, drilling from the deviated portion of said primary wellbore at least one drainhole wellbore, said drainhole wellbore extending into or near the subterranean area from which said mineral is to be produced, said drainhole wellbore having a radius of curvature in the range of from about 0.2 degrees per 1 foot of wellbore length to about 3 degrees per 1 foot of wellbore length.

2. The method of claim 1 wherein a plurality of drainhole wellbores are drilled from a single primary wellbore.

3. The method of claim 2 wherein said drainhole wellbores are drilled at a plurality of points around the periphery of said primary wellbore.

4. The method of claim 3 wherein said drainhole wellbores are spaced apart along a portion of the length of said primary wellbore.

5. The method of claim 1 wherein said primary wellbore is drilled so as to extend under a subterranean area to be produced, and at least one drainhole wellbore is drilled upwardly from said primary wellbore into said area to be produced so that produced mineral gravitates downwardly from said area through said drainhole wellbore and into said primary wellbore.

6. The method of claim 5 wherein said subterranean area contains viscous crude oil.

7. The method of claim 1 wherein said at least one drainhole wellbore penetrates a plurality of spaced apart mineral producing formations.

* * * * *